US008081911B2

(12) United States Patent
Yamada et al.

(10) Patent No.: US 8,081,911 B2
(45) **Date of Patent: *Dec. 20, 2011**

(54) DEVELOPMENT ROLLER, DEVELOPMENT DEVICE, AND IMAGE FORMING APPARATUS

(75) Inventors: Yoichi Yamada, Shiojiri (JP); Masahiro Maeda, Matsumoto (JP); Junichi Suzuki, Chino (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 378 days.

This patent is subject to a terminal disclaimer.

(21) Appl. No.: 12/388,857

(22) Filed: Feb. 19, 2009

(65) Prior Publication Data

US 2009/0208255 A1 Aug. 20, 2009

(30) Foreign Application Priority Data

Feb. 20, 2008 (JP) ..... 2008-038704
Feb. 20, 2008 (JP) ..... 2008-038705

(51) Int. Cl.
*G03G 15/08* (2006.01)

(52) U.S. Cl. ..... 399/286

(58) Field of Classification Search ..... 399/252, 399/279, 286; 430/108.7
See application file for complete search history.

(56) References Cited

U.S. PATENT DOCUMENTS 4,368,971 A 1/1983 Watanabe et al.
4,564,285 A 1/1986 Yasuda et al.
4,737,216 A 4/1988 Lounsbury, Jr. et al.
4,866,480 A * 9/1989 Hosoya et al. ..... 399/281
5,062,385 A 11/1991 Nishio et al.
5,387,966 A 2/1995 Karashima
6,104,903 A * 8/2000 Hara et al. ..... 399/286 X
6,149,564 A * 11/2000 Nozawa et al. ..... 492/30
6,201,942 B1 3/2001 Honda et al.
6,205,313 B1 3/2001 Bean
6,512,910 B2 1/2003 Aoki et al.
6,681,092 B2 * 1/2004 Terai ..... 399/286 X
6,725,007 B2 4/2004 Igarashi
6,873,816 B2 * 3/2005 Akashi et al. ..... 399/286
7,209,691 B2 4/2007 Takahashi et al.
7,565,099 B2 7/2009 Yamada et al.
7,702,264 B2 4/2010 Hirota et al.
7,907,879 B2 * 3/2011 Yamada et al. ..... 399/286
2006/0062599 A1 3/2006 Shimmura et al.
2007/0104517 A1 5/2007 Shimmura et al.
2007/0110481 A1 5/2007 Yamada et al.

(Continued)

FOREIGN PATENT DOCUMENTS

JP 64005738 A 1/1989

(Continued)

OTHER PUBLICATIONS

European search report for corresponding European application 09002262.5.

(Continued)

*Primary Examiner* — Sandra Brase
(74) *Attorney, Agent, or Firm* — DLA Piper LLP (US)

(57) ABSTRACT

A development roller includes a base unit having a base recess and a base projection formed in a predetermined area of a circumference surface of the base unit, and a surface layer formed on the circumference surface of the base unit and having a recess and a projection formed respectively in accordance with the base recess and the base projection of the base unit.

14 Claims, 9 Drawing Sheets

U.S. PATENT DOCUMENTS

| | | | | |
|---|---|---|---|---|
| 2007/0177908 | A1 | 8/2007 | Aruga et al. | |
| 2007/0206240 | A1 | 9/2007 | Koike et al. | |
| 2007/0212088 | A1 | 9/2007 | Koike et al. | |
| 2008/0298853 | A1 | 12/2008 | Yamada et al. | |
| 2009/0208256 | A1* | 8/2009 | Yamada et al. | 399/286 |

FOREIGN PATENT DOCUMENTS

| | | | |
|---|---|---|---|
| JP | 01170969 | A | 7/1989 |
| JP | 01253776 | A | 10/1989 |
| JP | 02121740 | A | 5/1990 |
| JP | 08227219 | A | 9/1996 |
| JP | 2001154477 | A | 6/2001 |
| JP | 2004037951 | A | 2/2004 |
| JP | 2006091833 | A | 4/2006 |
| JP | 2006201505 | A | 8/2006 |
| JP | 2006259384 | A | 9/2006 |
| JP | 2006267805 | A | 10/2006 |
| JP | 2007-121948 | | 5/2007 |
| JP | 2007121950 | A | 5/2007 |
| JP | 2007183312 | A | 7/2007 |
| JP | 2007199196 | A | 8/2007 |
| JP | 2007218993 | A | 8/2007 |
| JP | 2007233196 | A | 9/2007 |
| JP | 2007264519 | A | 10/2007 |
| JP | 2007279251 | A | 10/2007 |
| JP | 2008009059 | A | 1/2008 |
| JP | 2008020862 | A | 1/2008 |
| JP | 2008031519 | A | 2/2008 |
| JP | 2008122481 | A | 5/2008 |
| JP | 2008122715 | A | 5/2008 |

OTHER PUBLICATIONS

Partial European search report dated Jul. 16, 2009 for European application 09002261.7.

Extended European search report dated Jun. 5, 2009 for European application 09002337.5.

* cited by examiner

AGING OF DEVELOPMENT ROLLER

| | |
|---|---|
| ROUGHNESS DEPTH | 6 μm |
| ROUGHNESS PITCH | 100 μm |
| PROJECTION WIDTH | 60 μm |
| RECESS WIDTH | 40 μm |

TONER PARTICLE DIAMETER > ROUGHNESS DEPTH OF DEVELOPMENT ROLLER

AGING OF DEVELOPMENT ROLLER

DEVELOPMENT ROLLER, DEVELOPMENT DEVICE, AND IMAGE FORMING APPARATUS

BACKGROUND

1. Technical Field

The present invention relates to a development roller having a roughness on the circumference thereof for transporting toner to a latent image bearing unit, a development device containing the development roller, and an image forming apparatus containing the development device.

2. Related Art

Development devices developing a toner image from a latent image with one-component non-magnetic toner triboelectrically charge the toner on a development roller. A development roller known in the related art (such as the one disclosed in Japanese Unexamined Patent Application Publication No. JP-A-2007-121948) has a surface roughness on the circumference thereof, the roughness having a substantially flat top surface. With the surface roughness, the development roller triboelectrically charges the toner thereon. As illustrated in FIG. 7A, a development roller a includes a base unit b and a surface layer c plated on the base unit a as a coverage.

The development roller a generally remains in contact with a toner feed roller and a toner regulator (both not shown). Silica having a high hardness is used serving as an external additive that coats toner mother particles of the toner.

A roughness, composed a plurality of recesses m and projections e, is formed on the circumference of the base unit b. Edges are formed at the g of a top flat area f of the projection e. A roughness, composed of plurality of recesses h and projections i, is formed on the circumference of the surface layer c. Edges are formed at sides k of a top flat area j of the projection i.

The surface layer c is worn by the toner feed roller and the toner regulator in an image forming operation. The edges formed at the sides k of the projection i of the surface layer c are worn at a localized manner. As the image forming cycles increase, the projection i of the surface layer c of the development roller a is worn away and rounded in a curved surface as illustrated in FIG. 7B. The edges are formed at the sides k of the flat area j of the projection j. If the projection j of the surface layer c is worn and rounded, the sides g of the flat area f of the projection e become rapidly exposed. If part of the base unit is exposed, the charging property of the toner on the development roller a is lowered, and it becomes difficult to perform efficiently a charging operation. If a low-cost iron (Fe) based material is used for the base unit b, the exposure of the base unit can lead to corrosion. If the base unit b is exposed early, the service life of the development roller a is shortened. There is room for improvement in the durability of the development roller a. Even if the sides k of the projection portion j are not edged, a portion at the sides k may be worn in a localized fashion. The same problem may still be expected.

SUMMARY

An advantage of some aspects of the invention is that a development roller with a surface roughness formed thereon has a durability high enough to perform an excellent development operation for a long period of time. A development device, and an image forming apparatus, each containing the development roller, also perform an image developing operation for a long period of time.

In accordance with one embodiment of the invention, a development roller includes projections, each having a curved base projection surface. More specifically, each base projection has no edge. As the number of image forming operations increases, the projection of a surface layer is worn to a curve approximately similar to the curved surface of a base projection. Even if the surface layer is worn, a base unit is not exposed at an early stage of service, and the durability of the development roller is effectively increased. The toner charging property of the development roller is maintained at an excellent level for a long period of time. Even if a typically low-cost iron (Fe) based material is used, the base unit is prevented from being corroded for a long period of time.

A large number of base recesses, each having a curved recess surfaces, and a large number of base projections, each having a curved projection surface, respectively adjacent to the recesses are extended circumferentially or along the axis of the development roller in a wave configuration. The durability of the development roller is further increased. In particular, the wave configuration of the roughness (recess and projection) on the base unit is set to be a sinusoidal wave configuration, and the durability of the development roller is increased even more.

A development device containing the development roller excellently develops a toner image on a latent image bearing unit from an electrostatic image for a long period of time. An image forming apparatus containing the development device can thus form a reliable and high-quality image for a long period of time.

In accordance with another aspect of the invention, a thickness of the surface layer is set to be larger than a maximum difference at a side of a flat portion of the projection, and a width of the base projection of the base unit along a line extending at half the depth of the base recess of the base unit is larger than a width of the base recess of the base unit along the line. A localized wear on the surface layer at the flat portion of the projection is controlled more as the degree of wear further advances. The surface layer at the flat portion of the projection is curved in a sinusoidal configuration. In the course of the wearing of the surface layer as a result of a long service life of the development roller, an early exposure of the base unit is prevented. The durability of the development roller is effectively increased. The toner charging property on the development roller is excellently maintained for a long period of time. Even with a typically low-cost iron material used, the base unit 25*a* is prevented from being corroded for a long period of time.

A localized and non-uniform wear of the surface layer is prevented, thereby increasing a wear area and leading to a decrease in the wear rate of the surface layer. This slows the exposure of the edge of the base unit. The service life of the development roller is even more extended.

The development device containing the development roller keeps the base material unexposed, thereby developing toner images on a latent image bearing unit in accordance with electrostatic latent images for a long period of time.

The wear trace of the surface layer is smoothed as the surface layer is worn. The surface layer is worn in a sinusoidal wave configuration, reducing a contact area between a toner regulator blade and the development roller. A sound "qui, qui, . . . " caused when the toner regulator blade presses the toner against the development roller and unsmooth sliding of the toner regulator blade are controlled.

The toner particles may be coated with silica as an external additive, and the coverage ratio of silica to the toner particles may be 100% or more. Silica is abundant in the surface of the toner mother particles and separated silica is also abundant in the toner. This causes a relatively high wear rate in the surface layer at the projection. Even if the toner having the silica coverage ratio of 100% or more is used, the durability of the development roller is still increased.

The development device containing the development roller can develop a toner image on the latent image bearing unit in accordance with a latent image for a long period of time. The image forming apparatus containing the development device can form a stable and high-quality image for a long period of time.

BRIEF DESCRIPTION OF THE DRAWINGS

The invention will be described with reference to the accompanying drawings, wherein like numbers reference like elements.

DESCRIPTION OF EXEMPLARY EMBODIMENTS

The embodiments of the invention are described below with reference to the drawings.

Figure 1:
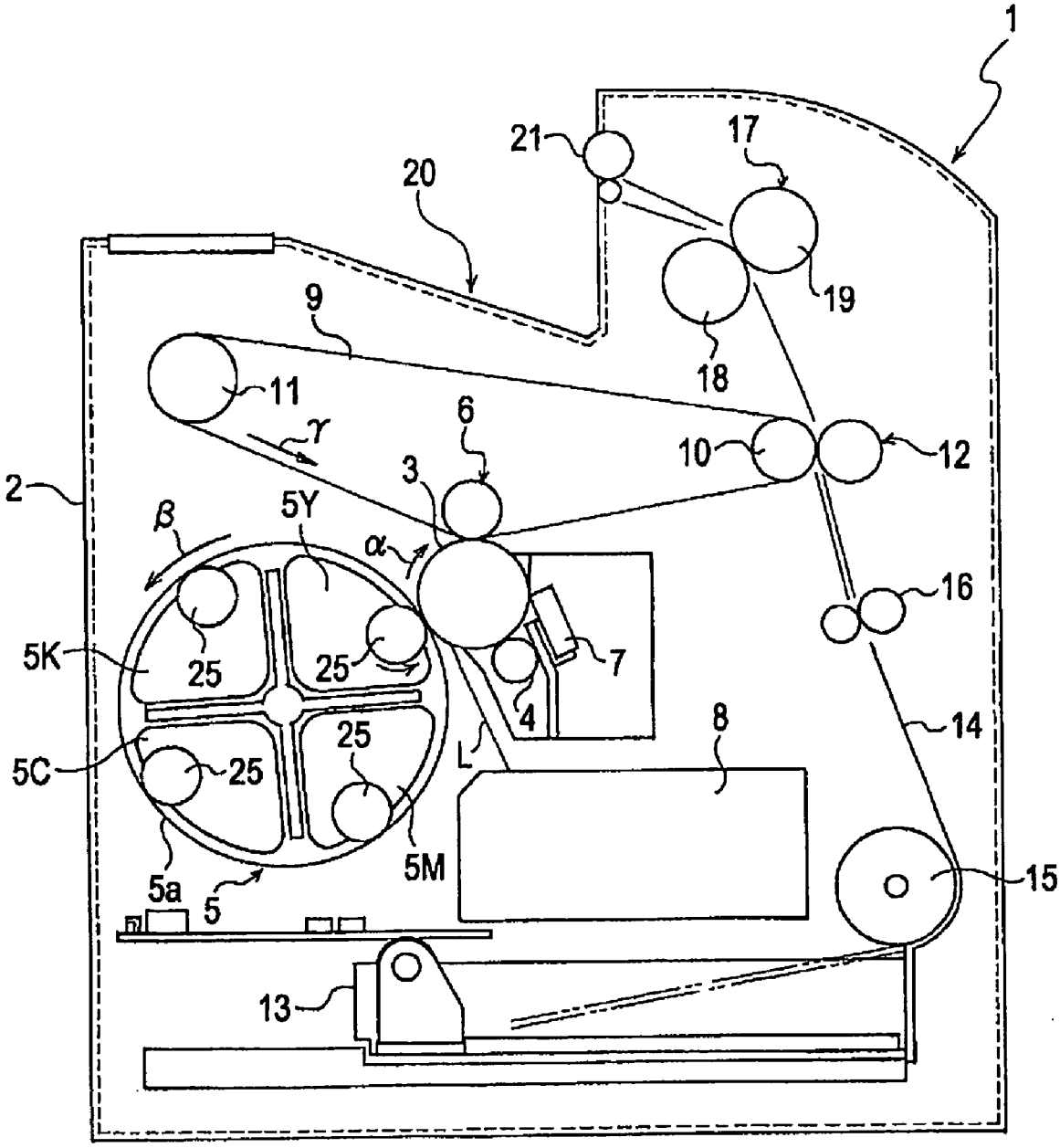
FIG. 1 illustrates an image forming apparatus in accordance with one embodiment of the invention.

FIG. 1 diagrammatically illustrates an image forming apparatus 1 in accordance with one embodiment of the invention.

With reference to FIG. 1, a photoconductor unit 3 as an image bearing unit is supported in an apparatus body 2 in a manner such that the photoconductor unit 3 is clockwise rotated in a direction of rotation α. A charging device 4 is arranged in the vicinity of the circumference of the photoconductor unit 3. Also arranged in the direction of rotation α of from the charging device 4 to the photoconductor unit 3 around the photoconductor unit 3 are a rotary development unit 5 as a development device, a primary transfer device 6, and a cleaning device 7. The rotary development unit 5 includes a development device 5Y for yellow color, a development device 5M for magenta color, a rotary development unit 5C for cyan color, and a development device 5K for black. These development devices 5Y, 5M, 5C and 5K are detachably supported in a rotary 5*a* that is rotatable about a center axis in a direction of rotation β (counterclockwise rotation in FIG. 1). An exposure device 8 is arranged below the charging device 4 and the cleaning device 7.

The image forming apparatus 1 further includes an intermediate transfer belt 9 having an endless structure as an intermediate transfer medium. The intermediate transfer belt 9 is entrained about a belt driving roller 10 and a driven roller 11. A driving force of a motor (not shown) is conveyed to the belt driving roller 10. The belt driving roller 10 causes the intermediate transfer belt 9 to rotate in a rotational direction γ (counterclockwise rotation in FIG. 1) while the intermediate transfer belt 9 is pressed by the primary transfer device 6 against the photoconductor unit 3.

A secondary transfer device 12 is arranged next to the belt driving roller 10 of the intermediate transfer belt 9. A transfer material cassette 13 is arranged below the exposure device 8. The transfer material cassette 13 holds a sheet-like transfer material such as a transfer paper sheet (corresponding to a transfer medium in accordance with one embodiment of the invention). A pickup roller 15 and a gate roller pair 16 are arranged close to the secondary transfer device 12 in a transfer material transport path 14 extending from the transfer material cassette 13 to the secondary transfer device 12.

A fixing device 17 is arranged above the secondary transfer device 12. The fixing device 17 includes a heater roller 18 and a pressure roller 19 pressed against the heater roller 18. A transfer material discharge tray 20 is arranged on the top portion of the apparatus body 2. A pair of transfer material discharge rollers 21 are arranged between the fixing device 17 and the transfer material discharge tray 20.

In the image forming apparatus 1 thus constructed, a yellow electrostatic latent image, for example, is formed on the photoconductor unit 3 uniformly charged by the charging device 4 in response to laser light L from the exposure device 8. The yellow electrostatic latent image is developed on the photoconductor unit 3 by yellow toner of the yellow development device 5Y at a development position (not shown) determined when the rotary 5*a* rotates. A yellow toner image is thus developed on the photoconductor unit 3. The yellow toner image is then transferred to the intermediate transfer belt 9 by the primary transfer device 6. Toner remaining on the photoconductor unit 3 subsequent to the transfer operation is scraped off by a cleaning blade or the like of the cleaning device 7 and then recycled.

Similarly, a magenta image is formed by the exposure device 8 on the photoconductor unit 3 that is uniformly charged by the charging device 4. The magenta electrostatic latent image is developed by magenta toner of the magenta development device 5M at the development position. The magenta image on the photoconductor unit 3 is transferred to the intermediate transfer belt 9 by the primary transfer device 6 in a manner such that the magenta image is superimposed on the yellow image. Toner remaining on the photoconductor unit 3 subsequent the transfer operation is recycled by the cleaning device 7. A similar operation is repeated for cyan and black toners. The toner images are successively formed on the photoconductor unit 3, and then superimposed on the preceding toner images on the intermediate transfer belt 9. A full-color toner image is then formed on the intermediate transfer belt 9. Similarly, toner remaining on the photoconductor unit 3 subsequent to each transfer operation is recycled by the cleaning device 7.

The full-color toner image transferred onto the intermediate transfer belt 9 is then transferred by the secondary transfer device 12 to the transfer material transported from the transfer material cassette 13 via the transfer material transport path 14. The transfer material is then transported to the secondary transfer device 12 at a timing with the full-color toner image of the intermediate transfer belt 9 by the gate roller 16.

The toner image pre-fixed to the transfer material is heated and pressure-fixed by the heater roller 18 and the pressure roller 19 in the fixing device 17. The transfer material having the image thereon is transported via the transfer material transport path 14, discharged to the transfer material discharge tray 20 via the transfer material discharge roller pair 21 and then held there.

A characteristic structure of the image forming apparatus 1 is described below.

The development devices 5Y, 5M, 5C, and 5K in the image forming apparatus 1 are identical in structure. In the discussion that follows, the rotary development unit 5 is representatively discussed without individually referring to the development devices 5Y, 5M, 5C, and 5K. In this case, reference number 51 is used to discriminate the development device from the rotary development unit 5.

Figure 2:
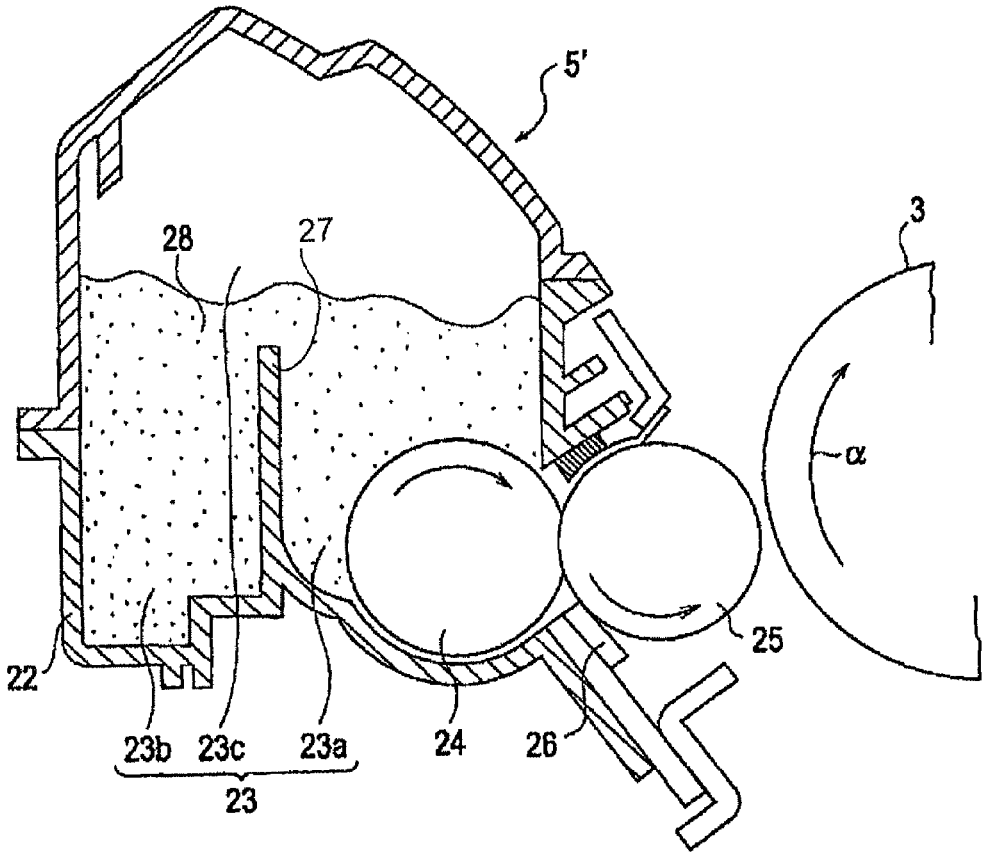
FIG. 2 is a sectional view diagrammatically illustrating a development device illustrated in FIG. 1.

FIG. 2 is a sectional view of the development device 5' taken in a direction perpendicular to the longitudinal direction of the development device 5' in accordance with one embodiment of the invention.

The development device 5' has a form of an elongated container. With reference to FIG. 2, the development device 5' has the same structure as the development device disclosed in Japanese Unexamined Patent Application Publication No. JP-A-2007-121948. More specifically, the development device 5' includes in an elongated housing 22 a toner container 23, a toner feed roller 24, a development roller 25, and a toner regulator member 26. The toner container 23, the toner feed roller 24, the development roller 25, and the toner regulator member 26 extend in the longitudinal direction of the development device 5' (i.e., in a direction perpendicular to the plane of the page of FIG. 2).

The toner container 23 is partitioned into two toner compartments 23*a* and 23*b* by a partitioning wall 27. The toner container 23 includes a common section 23*c* through which the first and second toner compartments 23*a* and 23*b* are open to each other in FIG. 2. The partitioning wall 27 limits the movement of toner 28 between the first and second toner compartments 23*a* and 23*b*. When the development device 5' is turned upside down from the position illustrated in FIG. 2 with the rotary 5*a* of the rotary development unit 5 rotated, the toner 28 stored in each of the first and second toner compartments 23*a* and 23*b* moves to the common section 23*c*. The rotary 5*a* further rotates, causing the development device 5' to be positioned to the state illustrated in FIG. 2. The toner 28 then moves back to each of the first and second toner compartments 23*a* and 23*b*. In this way, part of the toner 28 previously held in the first toner compartment 23*a* is moved to the second toner compartment 23*b* and part of the toner 28 previously held in the second toner compartment 23*b* is moved to the first toner compartment 23*a*. The toner 28 is thus agitated within the toner container 23. The toner 28 is one-component, non-magnetic toner with toner mother particles thereof coated with an external additive. In accordance with one embodiment of the invention, the external additive contains at least silica.

Referring to FIG. 2, the toner feed roller 24 is arranged in the lower portion of the first toner compartment 23*a* in a manner such that the toner feed roller 24 is clockwise rotatable. The development roller 25 is counterclockwise rotatably supported on the outside of the housing 22 as illustrated in FIG. 2. The development roller 25 is arranged close to the photoconductor unit 3 (in a non-contact fashion). The development roller 25 is pressed against the toner feed roller 24 at a predetermined pressure through an opening 22*a* of the housing 22. The toner regulator member 26 is also arranged on the housing 22. The toner regulator member 26 remains in contact with the development roller 25 downstream of a nip (contact point) between the development roller 25 and the toner feed roller 24. The toner regulator member 26 regulates a thickness of the toner 28 fed to the development roller 25 from the toner feed roller 24. The toner 28 regulated by the toner regulator member 26 is transported to the photoconductor unit 3 by the development roller 25. The electrostatic latent image is thus developed into the toner image on the photoconductor unit 3 by the toner 28 transported by the development roller 25. The toner image of each color thus results on the photoconductor unit 3.

First Embodiment

Figure 3A:
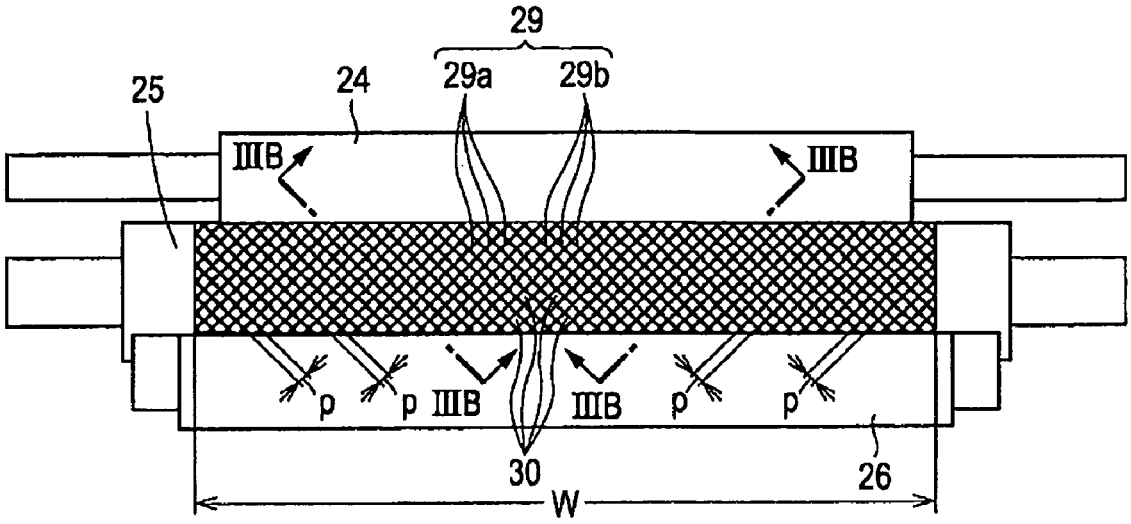
FIG. 3A diagrammatically illustrates a development roller, a toner feed roller, and a toner regulator unit.

FIG. 3A illustrates the circumference surface of the development roller 25 that has the same mesh roughness pattern as the one on the development roller discussed with reference to Japanese Unexamined Patent Application Publication No. JP-A-2007-121948. In the development roller 25, grooves 29 are formed in a roughness pattern in predetermined positions in the axial direction thereof on the whole circumference surface. The grooves 29 include first grooves 29*a* of a predetermined number continuously spiraling at a predetermined angle with respect to the axial direction of the development roller 25 (the predetermined slant angle is 45° in FIG. 3A, but not limited to 45°), and second grooves 29*b* of a predetermined number continuously spiraling at an angle opposite to the slant angle of the first grooves 29*a*. The first and second grooves 29*a* and 29*b* are formed at the respective slant angles at a predetermined pitch p with regular interval of W along the axial direction of the development roller 25. The first and second grooves 29*a* and 29*b* may be different from each other in slant angle and pitch.

Figure 3B:
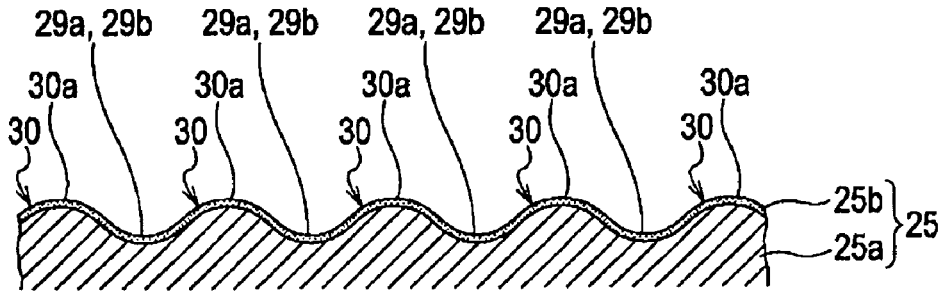
FIG. 3B is a partial sectional view illustrating part of the development roller and taken along line IIIB-IIIB in FIG. 3A.

With reference to FIG. 3B, the development roller 25 includes a base unit 25*a*, and a surface layer 25*b* formed on the circumference surface of the base unit 25*a*. The base unit 25*a* is a metal sleeve made of an aluminum based metal such as 5056 aluminum alloy or 6063 aluminum alloy, or an iron based metal such as STKM steel. The surface layer 25*b* is a nickel-based or chromium-based layer plated on the base unit 25*a*.

Figure 3C:
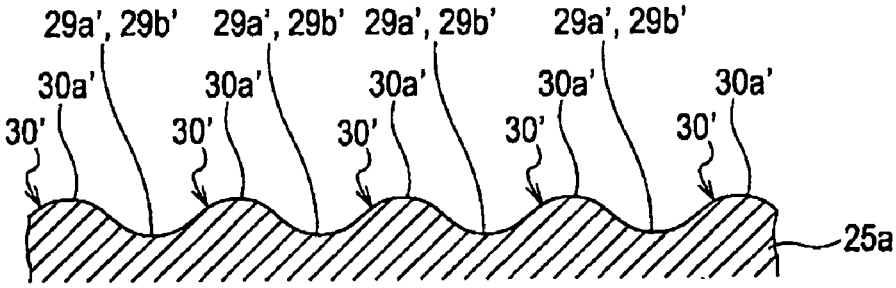
FIG. 3C is a partial sectional view illustrating only a base unit of the development roller.

Referring to FIG. 3C, first and second grooves 29*a*' and 29*b*' serving as a base for the first and second grooves 29*a* and 29*b* are formed on the circumference surface of the base unit 25*a* of the development roller 25 through component rolling. The machining method of forming the first and second grooves 29*a*' and 29*b*' may be any known method. The discussion of the machining method is thus omitted here. The base unit 25*a* has island projections 30' of a predetermined number surrounded by the first and second grooves 29*a*' and 29*b*'. In the specification, the projections 30 refer to a projection protruded from the bottom of each of the first and second grooves 29*a*' and 29*b*'.

The first grooves 29*a*' having a curved recess surface in a sinusoidal wave extend at an inclination angle, and the projections 30' having a curved projection surface in a sinusoidal wave also extend adjacent to the respective first grooves 29*a*' at an inclination angle. The second grooves 29*b*' having a curved recess surface in a sinusoidal wave extend at a slant angle, and the projections 30' having a curved projection surface in a sinusoidal wave also extend adjacent to the respective the second grooves 29*b*'. The recesses composed of the first and second grooves 29*a*' and 29*b*' and the curved projection surfaces of the projections 30' adjacent to the recesses extend at inclination angles and form a continuously curved sinusoidal wave surface.

The circumference surface of the base unit 25*a* having the first and second grooves 29*a*' and 29*b*' and the projections 30' is electroless nickel plated. The surface layer 25*b* is thus formed on the surface of the base unit 25*a*. The first and second grooves 29*a* and 29*b* of the surface layer 25*b* are formed in a curved surface similar to the first and second grooves 29*a*' and 29*b*'. The curved recesses composed of the first and second grooves 29*a* and 29*b* and the curved projection surfaces of the projections 30 adjacent to the recesses form a continuously curved sinusoidal wave surface. In this way, the first and second grooves 29*a* and 29*b* and the projections 30 form a roughness portion (the recess and the projection) on the circumference surface of the development roller 25.

Figure 7A:
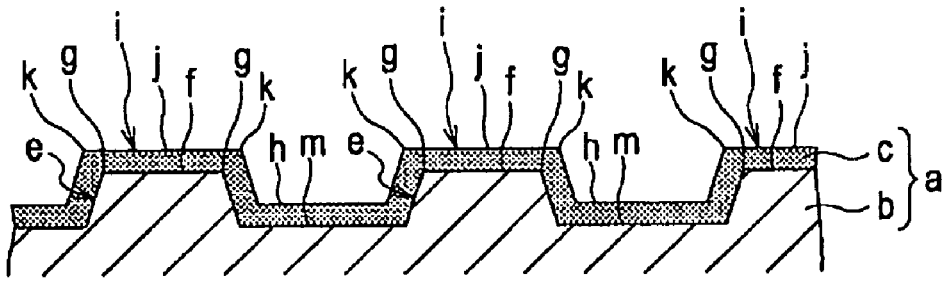
FIG. 7A is a partial sectional view partially illustrating a projection radially swollen in a development roller in the related art.
Figure 7B:
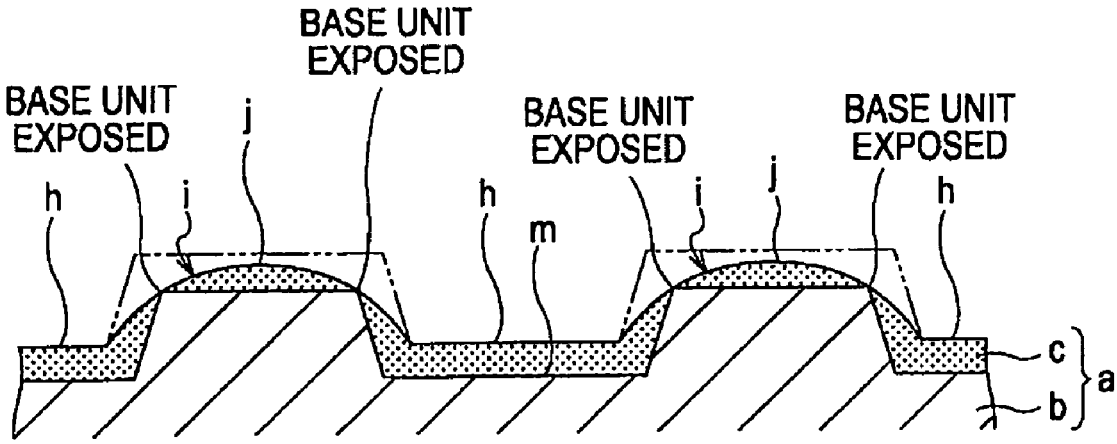
FIG. 7B is a partial sectional view illustrating the wear state of the projection of the development roller illustrated in FIG. 7A.

The inventor of the invention has studied the wear of the surface layer 25*b* of the development roller 25 illustrated in FIG. 7B by performing durability tests. The wear trace was measured using Keyence VK-9500 as a three-dimensional measuring laser microscope. The image forming apparatus used in the tests is printer model LP9000C manufactured by Seiko Epson. A development roller 25 to be discussed below was used instead of the original development roller in the printer model LP9000C. Printer model LP9000C was modified to employ the development roller 25. Image forming conditions in the durability tests were the standard image forming conditions of the printer model LP9000C.

Figure 4A:
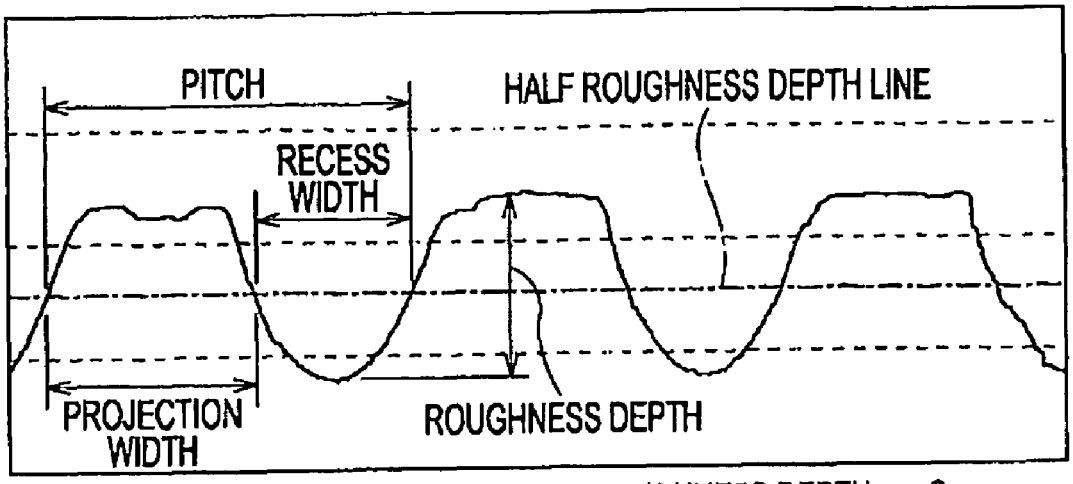
FIG. 4A illustrates a size of a roughness of the development roller.

Before forming the roughness portion on the base unit 25*a*, the base unit 25*a* of the development roller 25, made of STKM steel, was centerless machined in surface finishing. A nickel-phosphorus (Ni—P) layer is electroless plated to a thickness of 3 μm as the surface layer 25*b* on the base unit 25*a*. As illustrated in FIG. 4A, the development roller 25 was machined as below. In the development roller 25, the roughness depth (height from the bottom of the grooves 29*a* and 29*b* to the top surface of the projections 30) was 6 μm, the roughness pitch was 100 μm, the width of the projection 30 along a line extending at half the roughness depth was 60 μm, and the width of the recess along the half line was 40 μm.

The toner feed roller 24, made of urethane foam, was installed to press against the development roller 25 by an amount of sink of 1.5 mm. The toner regulator member 26 was constructed of a blade made of urethane rubber, and installed to be pressed against the development roller 25 under a pressure of 40 g/cm.

Two types of toner were used. A first type of toner was produced by manufacturing polyester particles through a pulverizing process, and by internally dispersing proper amounts of a charge control agent (CCA), a wax, and a pigment with the polyester particles into toner mother particles. Then externally added to the toner mother particles were small silica particles having a size of 20 nm, median silica particles having a size of 40 nm, and titania particles having a size of 30 nm. The process resulted in large size toner having an average diameter D50 of 8.5 μm. A second type of toner was produced by manufacturing polyester particles through a pulverizing process, and by internally dispersing proper amounts of a CCA, a wax, and a pigment with the polyester particles into toner mother particles. Then externally added to the toner mother particles were small silica particles having a size of 20 nm, median silica particles having a size of 40 nm, large silica particles having a size of 100 nm, and titania particles having a size of 30 nm. The process resulted in large size toner having an average diameter D50 of 6.5 μm.

Figure 4B:
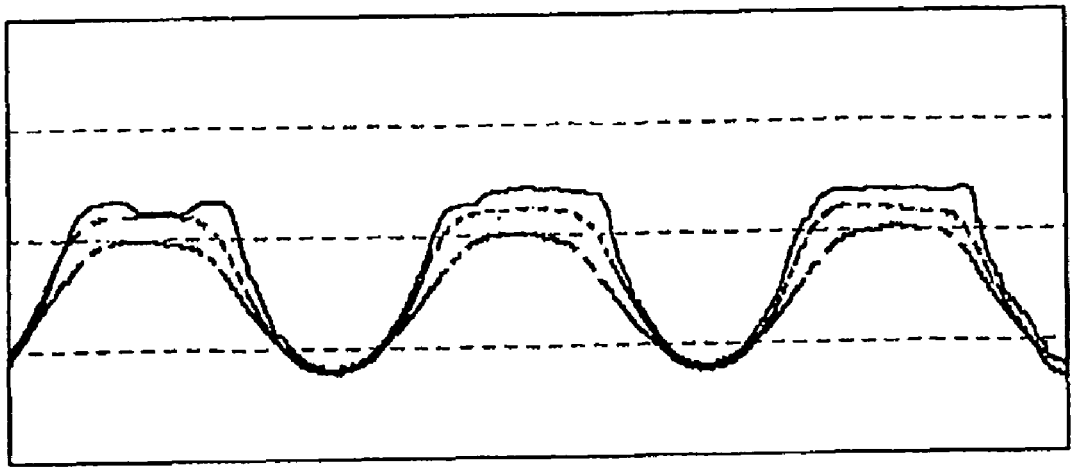
FIG. 4B illustrates a wear process of the development roller when a toner particle diameter is larger than a depth of the roughness of the development roller.

Durability image forming tests were conducted on A4 size standard sheets using a text pattern having a monochrome image occupancy rate of 5% under the standard image forming condition of the printer model LP9000C. When the first type large size toner was used, the top four side edges of the surface layer 25*b* at the projection 30 having an initial profile denoted by a solid line in FIG. 4B were worn into a curved profile denoted by a broken line as the number of image forming cycles increased. As the number of image forming cycles further increased, the original profile was worn into a profile having a curved flat surface 30*a* of the surface layer 25*b* of the projection 30 as denoted by a dot-and-dash chain line. When the second type large size toner was tested, the projections 30 tended to be worn into the curved profile similar to that when the first type toner was used.

The wear profile is analyzed more in detail. The curved wear profile illustrated in FIG. 4B tends to occur if the toner particle diameter (D50 diameter, namely, average particle diameter of 50% volume) is larger than the roughness depth of the development roller 25 (i.e., the toner particle diameter>the roughness depth of the development roller 25).

The possible reason why such a curved wear profile occurred is described below. As the development roller 25 rotates in FIG. 5A, the toner feed roller 24 and the toner regulator member 26 are respectively pressed against the development roller 25. Toner particles present on the flat surfaces 30*a* of the projections 30 move into the first and second grooves 29*a* and 29*b*. Since the average diameter of the toner particles is larger than the roughness depth, almost all the toner particles of the toner 28 having moved into the first and second grooves 29*a* and 29*b* are aligned in a single layer. As the development roller 25 further rotates, toner particles present in the first and second grooves 29*a* and 29*b* move onto the flat surfaces 30*a* of the projections 30. Toner particles present on the flat surfaces 30*a* of the projections 30 move into the first and second grooves 29*a* and 29*b*. A relatively large weight is applied on the upper edges of the surface layer 25*b* on the projection 30. As illustrated in FIG. 5B, the relatively hard external additive on the surface of each toner particle gradually wears the surface of the surface layer 25*b* and the upper edges thereof in the long service life of the development roller 25.

Figure 5A:
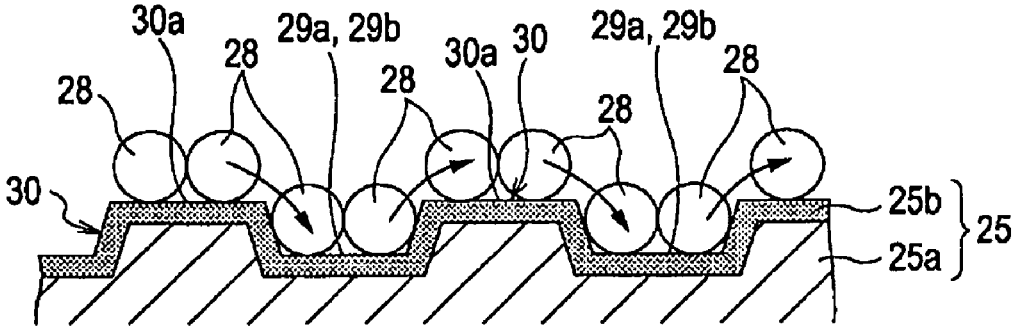
FIG. 5A illustrates the behavior of toner particles when the toner particle diameter is larger than the depth of the roughness of the development roller.
Figure 5B:
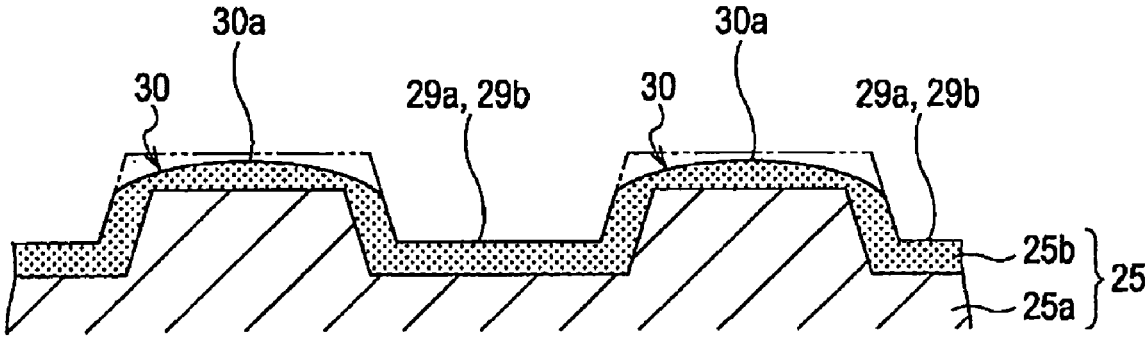
FIG. 5B illustrates the wear state of the development roller illustrated in FIG. 5A.

As FIG. 3B, FIGS. 5A and 5B are sectional views of the first and second grooves 29*a* and 29*b* taken along a line perpendicular to the slant angle thereof. The sectional views of the development roller 25 are not aligned with the direction of rotation of the development roller 25. Toner particles on the first grooves 29*a* move on the flat surfaces 30*a* of the projections 30, and then move to any of the first and second grooves 29*a* and 29*b* adjacent to the projections 30. Furthermore, toner particles on the second grooves 29*b* move on the flat surfaces 30*a* of the projections 30, and then move to any of the first and second grooves 29*a* and 29*b* adjacent to the projections 30.

The development roller 25 of one embodiment of the invention is specifically described below.

Figure 6A:
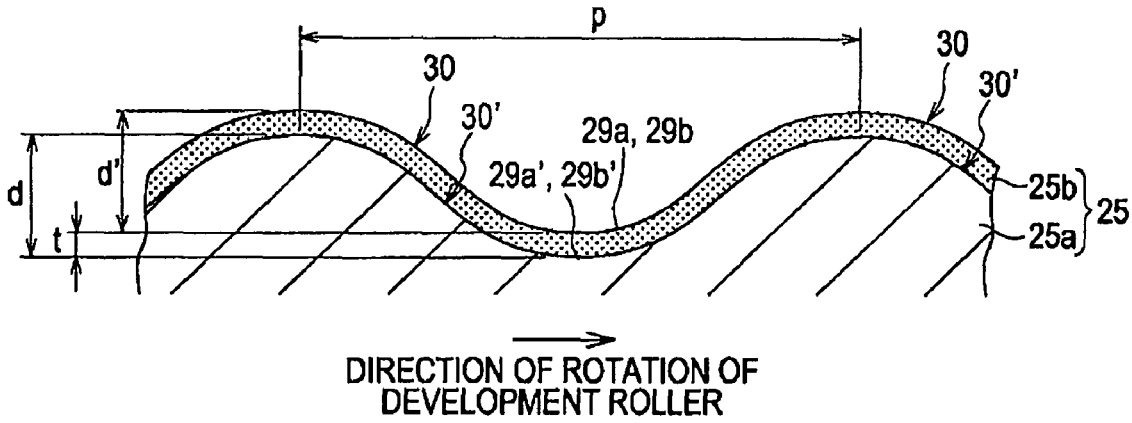
FIG. 6A is an expanded partial sectional view of the development roller illustrated in FIG. 3A.
Figure 6B:
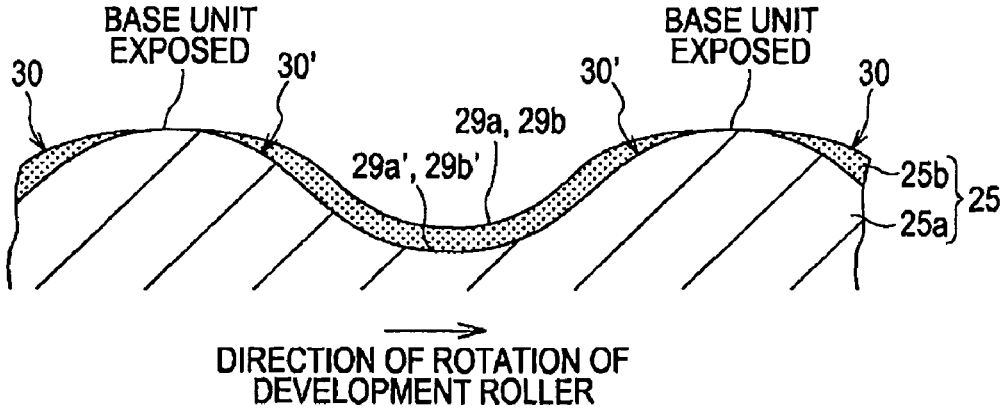
FIG. 6B illustrates the wear state of the development roller illustrated in FIG. 6A.

Before forming the roughness portion on the base unit 25*a*, the base unit 25*a* of the development roller 25, made of STKM steel, was centerless machined in surface finishing. As illustrated in FIG. 6A, the roughness portion having a sinusoidal wave configuration was formed on the surface of the base unit 25*a* through component rolling. The roughness portion had a roughness depth d' of 8 μm, and a roughness pitch p of 150 μm.

A nickel-phosphorus (Ni—P) layer is electroless plated to a thickness of 3 μm as the surface layer 25*b* on the base unit 25*a*. The roughness depth d of the surface layer 25*b* (from the bottom of the recess to the top surface of the projection 30) was 8 μm.

Similar durability tests were conducted on the development roller 25 with the previously described printer model LP9000C. The toner used was the first type large size toner having the average particle diameter D50 of 8.5 μm. The toner average particle diameter D50 of 8.5 μm was larger than the roughness depth d of the surface layer 25*b* of 8 μm. The surface layer 25*b* had the same curved wear profile as the one illustrated in FIG. 5B.

Since the roughness portion of the surface layer 25*b* and the roughness portion of the base unit 25*a* are curved in a sinusoidal wave configuration free from side edges, the surface layer 25*b* is worn in a curve having a sinusoidal wave configuration in a long image forming service life of the development roller 25. The projections 30' of the base unit 25*a* are not exposed in an early stage of service life. When the image forming process is repeated for a long period of time, the surface layer 25*b* close to the peak of the projection 30' of the base unit 25*a* is relatively heavily worn, thereby exposing the peak of the projection 30'. The development roller 25 then ends the service life thereof. The degree of wear of the surface layer 25*b* in the first and second grooves 29*a* and 29*b* is relatively smaller than the degree of wear of the peak of the projection 30'.

The development roller 25 thus includes the base projection 30' having the curved projection surface and the projection 30 of the surface layer 25*b* having the curved projection surface. More specifically, the projection 30' has no edge. With the image forming process repeated, the surface layer 25*b* is worn in a curve similar to the curved projection surface of the projection 30'. Even if the surface layer 25*b* is worn, the projection 30' of the base unit 25*a* is not exposed at an early stage of service life. The durability of the development roller 25 is effectively increased. The toner charging property of the development roller 25 is maintained at an excellent level for a long period of time. Even if a low-cost iron-based material is used for the base unit 25*a*, the base unit 25*a* is prevented from being corroded for a long period of time.

The development roller 25 thus include the curved recess surfaces of a large number of base recesses (first and second grooves 29*a*' and 29*b*') and the curved projection surfaces of a large number of base projections 30' respectively adjacent to the recesses, extending in a continuous wave configuration in a circumferential direction or an axial direction of the development roller 25. The durability of the development roller 25 is increased even more. In particular, if the continuous wave configuration is a sinusoidal wave configuration, the durability of the development roller 25 is substantially increased.

The development device 5' containing the development roller 25 repeatedly develops excellent electrostatic latent images on the photoconductor unit 3 for a long period of time. The use of the toner 28 having an average toner particles D50 larger than the roughness depth of the development roller 25 allows the surface layer 25*b* at the projection 30 to be worn in a curved wear configuration. The base unit 25*a* is thus prevented from being exposed for a long period of time.

The number and pitch of the second grooves 29*b* may or may not be identical to the number and pitch of the first grooves 29*a*. The number of first grooves 29*a* may be 1 or more, and the number of second grooves 29*b* may be 1 or more.

The toner particles are coated with silica having a relatively high hardness as an external additive with the silica coverage ratio to the toner mother particles being 100% or more. Silica is abundant in the surface of the toner mother particles and separated silica is also abundant in the toner. This causes a relatively high wear rate in the surface layer 25*b* of the projection 30. Such toner is typically used when toner fluidity is needed in one-component non-magnetic non-contact development. Even if the development roller 25 is used in the development device 5' that uses the toner having a silica coverage rate of 100% or more, the durability of the development roller 25 is still effectively increased.

The image forming apparatus 1 including the development device 5' can thus provide stable and excellent quality images for a long period of time.

The invention is applicable to the image forming apparatus 1 including the rotary development unit 5. The invention is not limited to the image forming apparatus 1. The invention is applicable to image forming apparatuses including a development device with the development roller having a roughness portion. Such image forming apparatuses include an image forming apparatus having an image forming units arranged in tandem, a four-cycle image forming apparatus, a monochrome image forming apparatus, and an image forming apparatus that directly transfers a toner image to a transfer material (transfer medium of one embodiment of the invention) from an image bearing unit (i.e., an image forming apparatus having no intermediate transfer medium). The invention is applicable to any image forming apparatus falling within the scope defined by the claims.

Second Embodiment

Figure 8A:
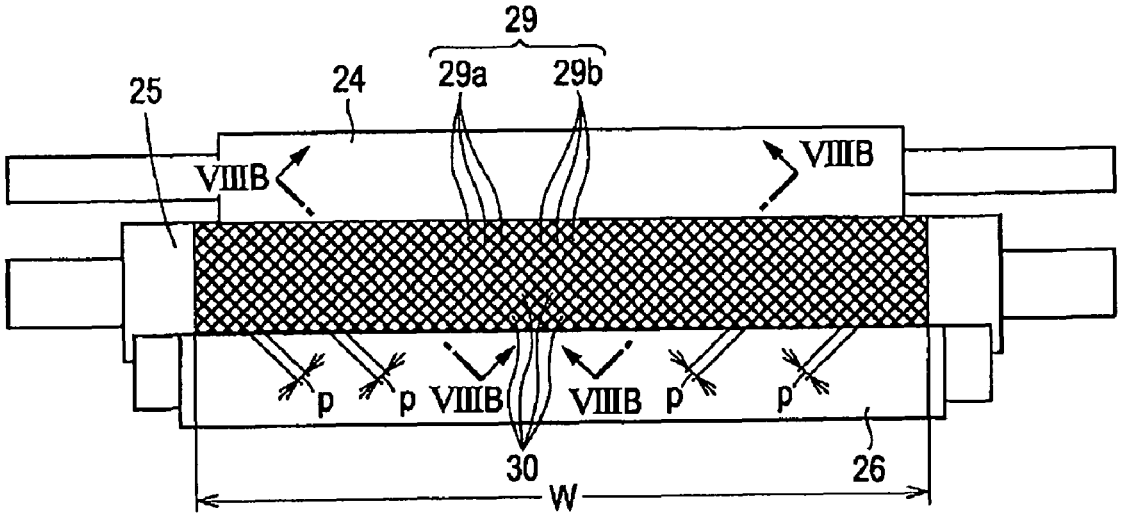
FIG. 8A diagrammatically illustrates a development roller, a toner feed roller, and a toner regulator unit.

Referring to FIG. 8A, a mesh-like roughness pattern is formed on the circumference surface of a development roller 25 as on the development roller 25 disclosed in Japanese Unexamined Patent Application Publication No. JP-A-2007-121948. This development roller 25 includes grooves 29 in a predetermined axial area on the circumference thereof as the roughness pattern. The grooves 29 include first grooves 29*a* of a predetermined number continuously spiraling at a predetermined angle with respect to the axial direction of the development roller 25 (the predetermined slant angle is 45° in FIG. 8A, but not limited to 45°), and second grooves 29*b* of a predetermined number continuously spiraling at an angle opposite to the slant angle of the first grooves 29*a*. The first and second grooves 29*a* and 29*b* are formed at the respective slant angles at a predetermined pitch p with regular interval of W along the axial direction of the development roller 25. The first and second grooves 29*a* and 29*b* may be different from each other in slant angle and pitch.

Figure 8B:
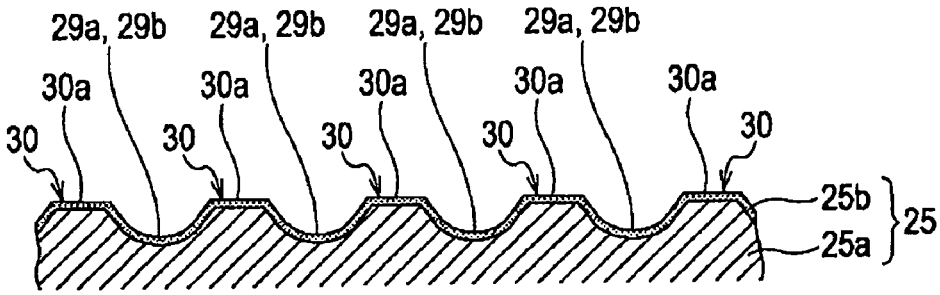
FIG. 8B is a partial sectional view illustrating part of the development roller and taken along line IIIB-IIIB in FIG. 8A.

With reference to FIG. 8B, the development roller 25 includes a base unit 25*a*, and a surface layer 25*b* formed on the circumference surface of the base unit 25*a*. The base unit 25*a* is a metal sleeve made of an aluminum based metal such as 5056 aluminum alloy or 6063 aluminum alloy, or an iron based metal such as STKM steel. The surface layer 25*b* is a nickel-based or chromium-based layer plated on the base unit 25*a*.

Figure 8C:
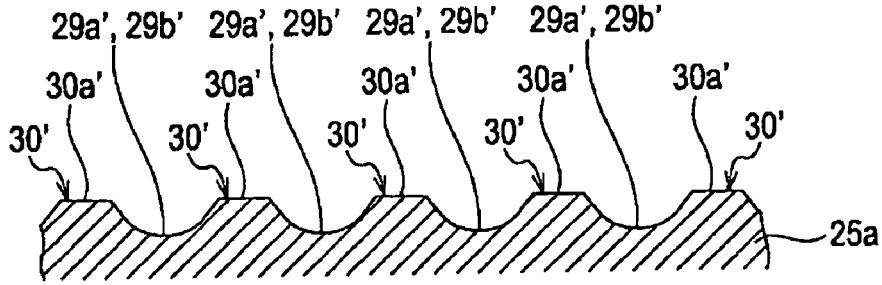
FIG. 8C is a partial sectional view illustrating only a base unit of the development roller.

Referring to FIG. 8C, first and second grooves 29*a*' and 29*b*' serving as a base for the first and second grooves 29*a* and 29*b* are formed on the circumference surface of the base unit 25*a* of the development roller 25 through component rolling. The machining method of forming the first and second grooves 29*a*' and 29*b*' may be any known method. The discussion of the machining method is thus omitted here. The base unit 25*a* has island projections 30' of a predetermined number surrounded by the first and second grooves 29*a*' and 29*b*'. In the specification, the projections 30 refer to a projection protruded from the bottom of each of the first and second grooves 29*a*' and 29*b*'.

Figure 9A:
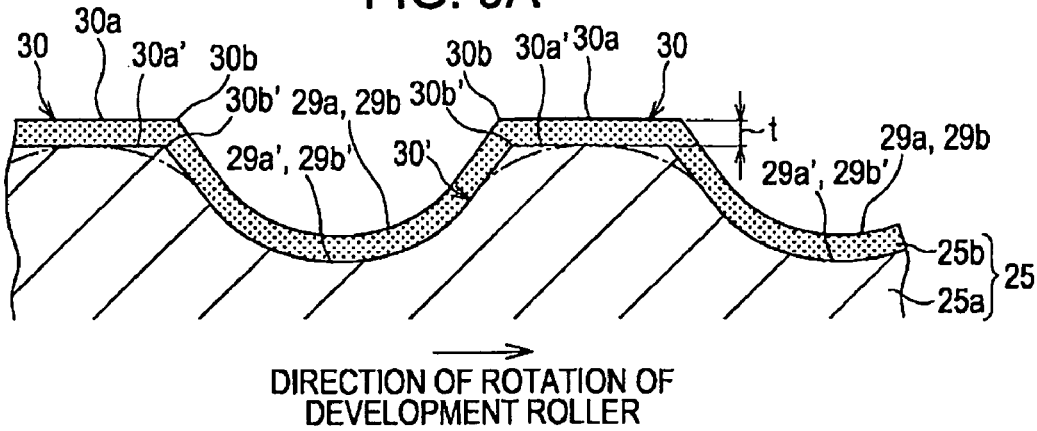
FIG. 9A illustrates a size of a roughness of the development roller.
Figure 9B:
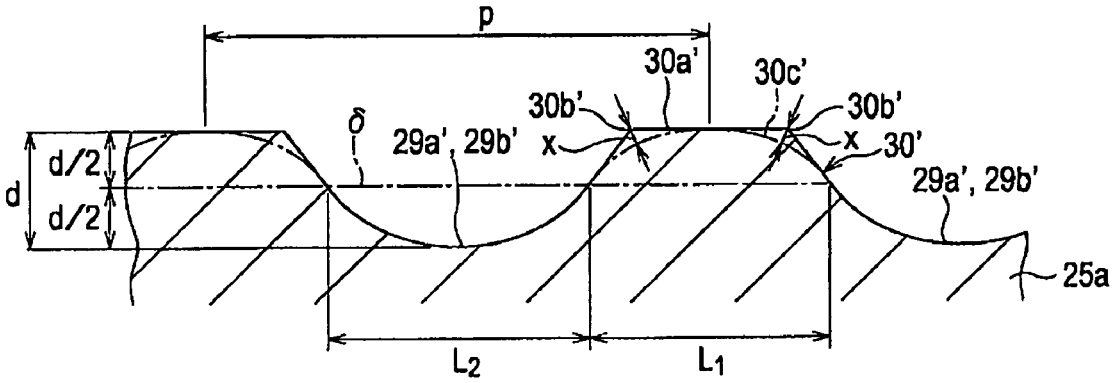
FIGS. 9B and 9C illustrates a wear process of the development roller when a toner particle diameter is larger than a depth of the roughness of the development roller.
Figure 9C:
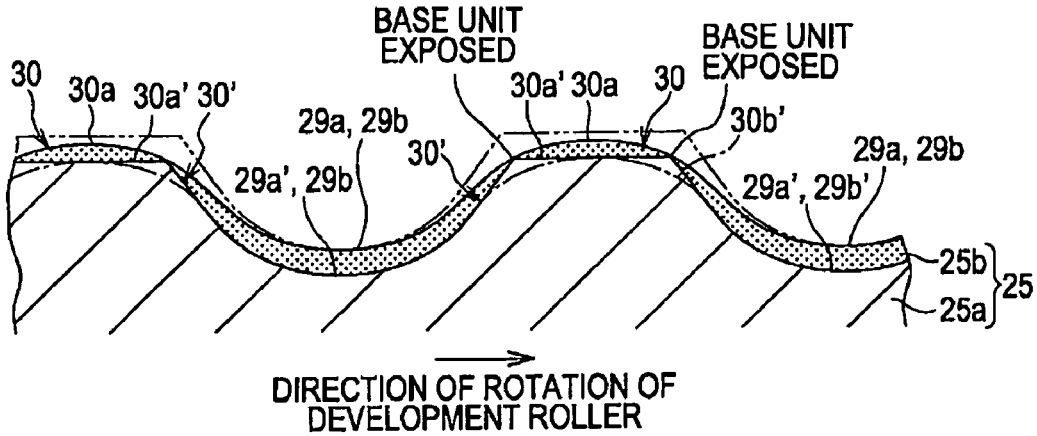

With reference to FIGS. 8C and 9C, the top of the projection 30' is formed at the flat surface 30*a*'. The flat surface 30*a*' of each the projection 30' is square if the first and second grooves 29*a*' and 29*b*' have a slant angle of 45° and the same pitches, and is diamond if the first and second grooves 29*a*' and 29*b*' have a slant angle of other than 45° and the same pitches. The flat surface 30*a*' of each the projection 30' is rectangular if the first and second grooves 29*a*' and 29*b*' have a slant angle of 45° and different pitches, and is parallelogrammic if the first and second grooves 29*a*' and 29*b*' have a slant angle of other than 45° and different pitches. Regardless of the type of quadrilateral of the flat surface 30*a*', the flat surface 30*a*' of the projection 30' becomes a quadrangular pyramid frustum with four inclined walls. Each of the four sides of the flat surface 30*a*' has an edge 30*b*'.

Each of the first and second grooves 29*a*' and 29*b*' has a curved recess surface in a sinusoidal wave configuration at an inclination angle. A width $L_1$ of the base projection 30' along a line δ extending at half the depth d of the roughness portion of the base unit 25*a* is larger than a width $L_2$ of each of the first and second grooves 29*a*' and 29*b*, (i.e., base recess) along the line δ ($L_1 \geqq L_2$). With reference to FIG. 9B, the flat surface 30*a*' of the base projection 30' is positioned at the peak of a sinusoidal wave surface 30*c*'. The sinusoidal wave surface 30*c*' (the wave configuration and the sinusoidal wave projection in accordance with one embodiment of the invention) is continued to the curved recess surface in a sinusoidal wave configuration of the first and second grooves 29*a*' and 29*b*' and has a pitch p and a depth d. The four side walls of a quadrangular pyramid frustum of the base projection 30' are formed respectively in continuation with four side walls of the sinusoidal wave curved recesses of the first and second grooves 29*a*' and 29*b*'. Points where the four side walls of the quadrangular pyramid frustum of the base projection 30' meet the four side walls of the sinusoidal wave curved recesses of the first and second grooves 29*a*' and 29*b*' are inflection points (intersections with the line δ).

The circumference surface of the base unit 25*a* having the first and second grooves 29*a*' and 29*b*' and the projections 30' is electroless nickel plated. The surface layer 25*b* is thus formed on the surface of the base unit 25*a*. The first and second grooves 29*a* and 29*b* and the projection 30 are formed on the surface layer 25*b* in a curved surface similar to the first and second grooves 29*a*' and 29*b*' and the base projection 30'. The flat surface 30*a* having a quadrilateral shape is formed on the projection 30. Regardless of the type of quadrilateral of the flat surface 30*a*', each of the four sides of the flat surface 30*a*' has an edge 30*b*. With the surface layer 25*b* formed on the base unit 25*a*, the flat surface 30*a* of the projection 30 becomes a quadrangular pyramid frustum with four inclined walls. The four side walls of the quadrangular pyramid frustum are respectively continued to the four side walls of the sinusoidal wave of the first and second grooves 29*a* and 29*b*.

In the development roller 25, a thickness t of the surface layer 25*b* is set to larger than a maximum distance x between the edges 30*b*' at the four sides of the flat surface 30*a* and the sinusoidal wave plane 30*c*' (x<t). The maximum distance x is a line segment of a line drawn perpendicular to the imaginary sinusoidal plane 30*c*' from the edge 30*b*'. The edge 30*b*' may be ambiguous or rounded. In such a case, as the maximum distance, the longest one may be selected from among line segments of lines that are drawn perpendicular to the imaginary sinusoidal plane 30*c*' and intersect the outline of the projection 30.

The inventor of the invention has studied the wear of the surface layer 25*b* of the development roller 25 illustrated in FIG. 7B by performing durability tests. The wear trace was measured using Keyence VK-9500 as a three-dimensional measuring laser microscope. The image forming apparatus used in the tests was printer model LP9000C manufactured by Seiko Epson. A development roller 25 to be discussed below was used instead of the original development roller in the printer model LP9000C. Printer model LP9000C was modified to employ the development roller 25. Image forming conditions in the durability tests were the standard image forming conditions of the printer model LP9000C.

Before forming the roughness portion on the base unit 25*a*, the base unit 25*a* of the development roller 25, made of STKM steel, was centerless machined in surface finishing. The first and second grooves 29*a*' and 29*b*' were formed on the base unit 25*a* through component rolling. A nickel-phosphorus (Ni—P) layer was electroless plated to a thickness of 3 μm as the surface layer 25*b* on the base unit 25*a*. As illustrated in FIG. 4A, the development roller 25 was machined as below. In the development roller 25, the roughness depth (height from the bottom of the grooves 29A and 29*b* to the top surface of the projections 30) was 6 μm, the roughness pitch was 100 μm, the width of the projection 30 along a line extending at half the roughness depth (hereinafter referred to as half line) was 60 μm, and the width of the recess along the half line was 40 μm.

The toner feed roller 24, made of urethane foam, was installed to press against the development roller 25 by an amount of sink of 1.5 mm. The toner regulator member 26 is constructed of a blade made of urethane rubber, and installed to be pressed against the development roller 25 under a pressure of 40 g/cm.

Two types of toner were used. A first type of toner was produced by manufacturing polyester particles through a pulverizing process, and by internally dispersing proper amounts of a charge control agent (CCA), a wax, and a pigment with the polyester particles into toner mother particles. Then externally added to the toner mother particles were small silica particles having a size of 20 nm, median silica particles having a size of 40 nm, and titania particles having a size of 30 nm. The process resulted in large size toner having an average diameter D50 of 8.5 μm. A second type of toner was produced by manufacturing polyester particles through a pulverizing process, and by internally dispersing proper amounts of a CCA, a wax, and a pigment with the polyester particles into toner mother particles. Then externally added to the toner mother particles were small silica particles having a size of 20 nm, median silica particles having a size of 40 nm, large silica particles having a size of 100 nm, and titania particles having a size of 30 nm. The process resulted in large size toner having an average diameter D50 of 6.5 μm.

Durability image forming tests were conducted on A4 size standard sheets using a 25% halftone monochrome image under the standard image forming condition of the printer model LP9000C. When the first type large size toner was used, the top four side edges of the surface layer 25*b* at the projection 30 having an initial profile denoted by a solid line in FIG. 4B were worn into a curved profile denoted by a broken line as the number of image forming cycles increased. As the number of image forming cycles further increased, the original profile was worn into a profile having a curved flat surface 30*a* of the surface layer 25*b* of the projections 30 as denoted by a dot-and-dash chain line. When the second type large size toner was tested, the projections 30 tended to be worn into the curved profile similar to that when the first type toner was used.

The wear profile is analyzed more in detail. The curved wear profile illustrated in FIG. 4B tends to occur if the toner particle diameter (D50 diameter, namely, average particle diameter of 50% volume) is larger than the roughness depth of the development roller 25 (i.e., the toner particle diameter>the roughness depth of the development roller 25).

The possible reason why such a curved wear profile occurred is described below. As the development roller 25 rotates in FIG. 5A, the toner feed roller 24 and the toner regulator member 26 are respectively pressed against the development roller 25. Toner particles present on the flat surfaces 30*a* of the projections 30 move into the first and second grooves 29*a* and 29*b*. Since the average diameter of the toner particles is larger than the roughness depth, almost all the toner particles of the toner 28 having moved into the first and second grooves 29*a* and 29*b* are aligned in a single layer. As the development roller 25 further rotates, toner particles present in the first and second grooves 29*a* and 29*b* move onto the top portion 30*a* of the projection 30 and toner particles present on the flat surfaces 30*a* of the projections 30 move into the first and second grooves 29*a* and 29*b*. A relatively large weight is applied on the upper four edges of the surface layer 25*b* on the projection 30. As illustrated in FIG. 5B, the relatively hard external additive on the surface of each toner particle wears the surface of the surface layer 25*b* and the four upper edges thereof in the long service life.

As FIG. 8B, FIGS. 5A and 5B are sectional views of the first and second grooves 29*a* and 29*b* taken along a line perpendicular to the slant angle thereof. The sectional views of the development roller 25 are not aligned with the direction of rotation of the development roller 25. Toner particles on the first grooves 29*a* move onto the flat surfaces 30*a* of the projections 30, and then move to any of the first and second grooves 29*a* and 29*b* adjacent to the projections 30. Furthermore, toner particles on the second grooves 29*b* move onto the flat surfaces 30*a* of the projections 30, and then move to any of the first and second grooves 29*a* and 29*b* adjacent to the projections 30.

The development roller 25 of one embodiment of the invention is specifically described below.

Before forming the roughness portion on the base unit 25*a*, the base unit 25*a* of the development roller 25, made of STKM steel, was centerless machined in surface finishing. As illustrated in FIG. 9B, the roughness portion having a sinusoidal wave configuration was formed on the surface of the base unit 25*a* through component rolling. The base recesses 29*a*' and 29*b*' (the bottoms of the recesses of the projections 30') were formed in a sinusoidal wave configuration. When the sinusoidal wave surface 30*c*' continued to the sinusoidal wave configuration of the base recesses 29*a*' and 29*b*' was produced, the flat surface 30*a*' was positioned at the peak of the sinusoidal wave surface 30*c*'. The flat surface 30*a*' of the base projection 30, became a quadrangular pyramid frustum with four inclined walls. The four inclined walls were formed respectively in continuation with the four walls of the sinusoidal wave recesses 29*a*' and 29*b*'. Points where the four side walls of the quadrangular pyramid frustum of the base projection 30' meet the four side walls of the sinusoidal wave curved recesses of the first and second grooves 29*a*' and 29*b*' are inflection points of the sinusoidal wave surface 30*c*'. The roughness portion thus constructed had a roughness depth d (height from the bottom of base recess to the top of the base projection) of 8 μm, and a roughness pitch p of 150 μm. The maximum distance x was 2 μm.

A nickel-phosphorus (Ni—P) layer was electroless plated to a thickness of t of 3 μm as the surface layer 25*b* on the base unit 25*a* (i.e., x<t). The roughness depth d of the surface layer 25*b* (from the bottom of the recess to the top surface of the projection 30) was 8 μm.

Similar durability tests were conducted on the development roller 25 with the previously described printer model LP9000C. The toner used was the first type large size toner having the average particle diameter D50 of 8.5 μm. The toner average particle diameter D50 of 8.5 μm was larger than the roughness depth d of the surface layer 25*b* of 8 μm. The surface layer 25*b* had the same curved wear profile as the one illustrated in FIG. 4B. Since the four sides of the flat surface 30*a* of the surface layer 25*b* are edged on the projection 30, the four sides of the flat surface 30*a* are worn in a curved shape rounder than the preceding wear profile.

The edge of the flat surface 30*a* of the surface layer 25*b* is thus worn in a localized fashion. However, since the thickness t of the surface layer 25*b* is smaller than the above-described difference x at the edge of the four sides of the flat surface 30*a*, the edge of the base projection 30 of the base unit 25*a* is free from an exposure at an early stage of service. The width $L_1$ of the base projection 30' at the line δ extending at half the depth d of the roughness portion of the base unit 25*a* (height of the base projection 30') is equal to or larger than the width $L_2$ of the first and second grooves 29*a*' and 29*b*' (i.e., the base recess) along the line δ ($L_1 \geqq L_2$). The surface layer 25*b* is gradually worn in a sinusoidal wave curve similar to the sinusoidal wave plane 30*c*' in a long image forming service life of the development roller 25. As a result, the entire projection 30 including the peak of the projection 30 (corresponding to the flat surface 30*a*) and the inclined side walls of the projection 30 is subject to a distributed weight from the toner feed roller 24, the toner regulator member 26, and toner particles. The localized wear is controlled, the wear trace area of the surface layer 25*b* increases, and the wear rate decreases. The time to the exposure of the edge of the base unit 25*a* is even more extended. Referring to FIG. 9C, the surface layer 25*b* at or near the peak of the projection 30' of the base unit 25*a* is worn relatively heavily, and the peak of the projection 30' is then exposed. The development roller 25 then ends the service life thereof. The degree of wear of the surface layer 25*b* in the first and second grooves 29*a* and 29*b* is relatively smaller than the degree of wear of the surface layer 25*b* at the peak of the projection 30'.

In the development roller 25, the thickness t of the surface layer 25*b* is smaller than the above-described difference x at the edge of the four sides of the flat surface 30*a*, and the width $L_1$ of the base projection 30' at the line 8 extending at half the depth d of the roughness portion of the base unit 25*a* (height of the base projection 30') is equal to or larger than the width $L_2$ of the first and second grooves 29*a*' and 29*b*' (i.e., the base recess) along the line δ. The localized wear of the surface layer 25*b* at the flat surface 30*a* of the projection 30 is controlled as the degree of wear advances. The surface layer 25*b* at the flat surface 30*a* of the projection 30 is gradually worn in a sinusoidal wave curve similar to the sinusoidal wave plane 30*c*' in a long image forming service life of the development roller 25. The base unit 25*a* is prevented from being exposed at an early stage of the service even if the surface layer 25*b* is continuously worn in a long image forming service life of the development roller 25. The durability of the development roller 25 is effectively increased. The toner charging property of the development roller 25 is maintained at an excellent level for a long period of time. Even if a low-cost iron-based material is used for the base unit 25*a*, the base unit 25*a* is prevented from being corroded for a long period of time.

Since the localized wear on the surface layer 25*b* is controlled, the wear trace area of the surface layer 25*b* increases. The wear rate of the base unit 25*a* is thus decreased. The time to the exposure of the edge of the base unit 25*a* is even more extended. The service life of the development roller 25 is lengthened.

As the surface layer 25*b* is worn, the wear surface becomes smoother. As the surface layer 25*b* is worn in a sinusoidal wave configuration, a contact area between the toner regulator member 26 and the development roller 25 is reduced. The sound "qui, qui, . . . " caused when the toner regulator blade 26 presses the toner against the development roller 25 and unsmooth sliding of the toner regulator blade are controlled.

The development device 5' containing the development roller 25 repeatedly develops toner images responsive to excellent electrostatic latent images on the photoconductor unit 3 for a long period of time. The base unit 25*a* is thus prevented from being exposed for a long period of time. The use of the toner 28 having an average toner particles D50 larger than the roughness depth of the development roller 25 increases the fluidity of the toner in the movement of the toner particles. The base unit 25*a* is thus prevented from being exposed for an even longer period of time. The image forming apparatus 1 containing the development roller 5' can provide high-quality images having a stable image hue level for a long period of time.

The number and pitch of the second grooves 29*b* may or may not be identical to the number and pitch of the first grooves 29*a*. The number of first grooves 29*a* may be 1 or more, and the number of second grooves 29*b* may be 1 or more.

The toner particles are coated with silica having a relatively high hardness as an external additive with the silica coverage ratio to the toner mother particles being 100% or more. Silica is abundant in the surface of the toner mother particles. This causes a relatively high wear rate in the surface layer 25*b* of the projection 30. Even if the development roller 25 is used in the development device 5' that uses the toner having a silica coverage rate of 100% or more, the durability of the development roller 25 is still effectively increased.

The base recesses of the first and second grooves 29*a'* and 29*b'* are not limited to the sinusoidal wave configuration. The base recesses may be curved or may be an inverted quadrangular pyramid frustum with a flat bottom surface. In such a case, the inverted quadrangular pyramid frustum may be continued to a quadrangular pyramid frustum of the base projection at inflection points thereof (at positions half the depth of the base roughness).

In the above-described embodiments, the invention is applied to the image forming apparatus 1 containing the rotary development unit 5. The invention is not limited to the image forming apparatus 1. The invention is applicable to image forming apparatuses including a development device with the development roller having a roughness portion. Such image forming apparatuses include an image forming apparatus having an image forming units arranged in tandem, a four-cycle image forming apparatus, a monochrome image forming apparatus, and an image forming apparatus that directly transfers a toner image to a transfer material (transfer medium of one embodiment of the invention) from an image bearing unit (i.e., an image forming apparatus having no intermediate transfer medium). The invention is applicable to any image forming apparatus falling within the scope defined by the claims.

What is claimed is:

1. A development roller, comprising a base unit having a base recess and a base projection formed at predetermined positions of a circumference surface of the base unit, and a surface layer formed on the circumference surface of the base unit and having a recess and a projection formed respectively in accordance with the base recess and the base projection of the base unit.

2. The development roller according to claim 1, wherein the base recess has a curved recess surface, wherein the curved recess surface of the base recess is continued to a curved projection surface of the base projection adjacent to the base recess, and wherein the curved recess surface of the base recess and the curved projection surface of the adjacent base projection continued thereto form a continuously curved wave configuration.

3. The development roller according to claim 2, wherein the wave configuration comprises a sinusoidal wave configuration.

4. The development roller according to claim 1, wherein the projection of the surface layer has a curved projection surface, and wherein the recess of the surface layer has a curved recess surface.

5. The development roller according to claim 1, wherein the surface layer is manufactured through electroless plating.

6. The development roller according to claim 1, wherein the base recess is a continuously spiraling groove.

7. A development device, comprising:

a development roller that transports toner to a latent image bearing unit, the development roller comprising a base unit having a base recess and a base projection formed in a predetermined area of a circumference surface of the base unit, and a surface layer formed on the circumference surface of the base unit and having a recess and a projection formed respectively in accordance with the base recess and the base projection of the base unit, a toner feed roller that remains in contact with the development roller to feed the toner, and a toner regulator unit that remains in contact with the development roller and regulates an amount of toner to be fed to the latent image bearing unit, wherein an average diameter of particles of the toner is larger than a depth of the recess of the development roller.

8. The development device according to claim 7, wherein the toner comprises one-component non-magnetic toner made of toner mother particles coated with an external additive and wherein the external additive contains at least silica, and wherein a coverage ratio of silica to the toner mother particles is 100% or more.

9. An image forming apparatus, comprising a latent image bearing unit on which at least an electrostatic latent image is formed, a development device that develops on the latent image bearing unit a toner image with toner in a non-contact development fashion in accordance with the electrostatic latent image, and a transfer device that transfers the toner image from the latent image bearing unit to a transfer medium, wherein the development device is the development device according to claim 7.

10. A development roller, comprising a base unit having a base recess and a base projection formed in a predetermined area of the circumference surface of the base unit, and a surface layer formed on the circumference surface of the base unit and having a recess and a projection formed respectively in accordance with the base recess and the base projection of the base unit, wherein a peak of the base projection is formed at a flat portion of the base unit, and the flat portion of the base unit is at a peak of an imaginary wave configuration that connects the recess and the projection in a section plane taken along a line connecting the center of the projection and the center of the adjacent projection, wherein a thickness of the surface layer is set to be larger than a maximum difference between the base projection and the imaginary wave configuration, and wherein a width of the base projection along a line extending at half the depth of the base recess is larger than a width of the base recess along the line.

11. A development roller, comprising a base unit having a base recess and a base projection formed in a predetermined area of the circumference surface of the base unit, and a surface layer formed on the circumference surface of the base unit and having a recess and a projection formed respectively in accordance with the base recess and the base projection of the base unit, wherein a thickness of the surface layer is set to be larger than a maximum difference between the base projection and an imaginary sinusoidal wave, the imaginary sinusoidal wave being defined by a depth and a pitch of the projection and the recess in a sectional plane taken along a line connecting the center of the projection and the center of the adjacent projection, and wherein a width of the base projection along a line extending at half the depth of the base recess is larger than a width of the base recess along the line.

12. The development roller according to claim 10, wherein the surface layer is manufactured through electroless plating.

13. The development roller according to claim 10, wherein the base recess is a continuously spiraling groove.

14. The development roller according to claim 10, wherein the base projection and the base recess of the development roller are formed through component rolling.

* * * * *